US011142818B1

(12) United States Patent
Lutz et al.

(10) Patent No.: US 11,142,818 B1
(45) Date of Patent: Oct. 12, 2021

(54) GRIT-BLASTED AND DENSIFIED BOND COAT FOR THERMAL BARRIER COATING AND METHOD OF MANUFACTURING THE SAME

(71) Applicant: HONEYWELL INTERNATIONAL INC., Morris Plains, NJ (US)

(72) Inventors: Bradley Lutz, Phoenix, AZ (US); Vladimir Tolpygo, Phoneix, AZ (US)

(73) Assignee: HONEYWELL INTERNATIONAL INC., Charlotte, NC (US)

( * ) Notice: Subject to any disclaimer, the term of this patent is extended or adjusted under 35 U.S.C. 154(b) by 0 days.

(21) Appl. No.: 17/020,080

(22) Filed: Sep. 14, 2020

(51) Int. Cl.

| | |
|---|---|
| ***C23C 4/18*** | (2006.01) |
| ***F01D 5/28*** | (2006.01) |
| ***C23C 4/073*** | (2016.01) |
| ***C23C 4/134*** | (2016.01) |

(52) U.S. Cl.
CPC ..... *C23C 4/18* (2013.01); *C23C 4/073* (2016.01); *C23C 4/134* (2016.01); *F01D 5/288* (2013.01); *F05D 2230/90* (2013.01)

(58) Field of Classification Search
CPC ..... C23C 4/18
See application file for complete search history.

(56) References Cited

U.S. PATENT DOCUMENTS

| | | | | |
|---|---|---|---|---|
| 5,763,107 | A | 6/1998 | Rickerby et al. | |
| 5,942,337 | A | 8/1999 | Rickerby et al. | |
| 5,981,091 | A | 11/1999 | Rickerby et al. | |
| 6,376,015 | B1 | 4/2002 | Rickerby | |
| 6,447,854 | B1 | 9/2002 | Rigney | |
| 7,264,887 | B2 | 9/2007 | Khan et al. | |
| 2005/0053800 | A1* | 3/2005 | Rigney | C23C 4/18 428/687 |
| 2005/0238907 | A1* | 10/2005 | Quadakkers | C23C 28/345 428/680 |
| 2005/0260434 | A1* | 11/2005 | Nelson | C23C 28/3215 428/632 |

* cited by examiner

*Primary Examiner* — Tabatha L Penny
(74) *Attorney, Agent, or Firm* — Lorenz & Kopf, LLP

(57) ABSTRACT

A method of providing a bond coat for a thermal barrier coating of a part of a turbomachine includes forming a first metallic bond coat layer on a substrate. The method also includes forming a second bond coat layer on the first metallic bond coat layer. The second bond coat layer has a porosity and a surface roughness that is greater than that of the first metallic bond coat layer. Furthermore, the method includes grit blasting the second bond coat layer to densify the second bond coat layer while substantially maintaining the surface roughness thereof.

11 Claims, 5 Drawing Sheets

GRIT-BLASTED AND DENSIFIED BOND COAT FOR THERMAL BARRIER COATING AND METHOD OF MANUFACTURING THE SAME

TECHNICAL FIELD

The present disclosure generally relates to a bond coat for a thermal barrier coating and, more particularly, relates to a grit-blasted and densified bond coat for a thermal barrier coating and a method of manufacturing the same.

BACKGROUND

Many parts include a metallic bond coat that bonds a ceramic topcoat to a substrate. The bond coat may also protect the substrate from chemical degradation, for example, from oxidation and hot corrosion. In some cases, ceramic thermal barrier coatings (TBCs) are provided on aero and industrial gas turbomachine parts (e.g., blades, vanes, shrouds and combustor liners, etc.). A bond coat is typically included for bonding the TBC to the substrate of the part and for oxidation or corrosion protection.

However, bond coats can suffer from one or more deficiencies. For example, some bond coats may not provide sufficient bonding between the topcoat and substrate in certain conditions. Furthermore, some bond coats may not provide sufficient protection from environmental degradation. Moreover, manufacturing techniques for applying the bond coat and/or the topcoat may be inefficient and expensive.

Accordingly, there is a longstanding and on-going need for a bond coat that provides improved bonding between the topcoat and substrate. There is also a need for a bond coat that provides improved oxidation and corrosion protection. Moreover, there is a need for an improved manufacturing technique for applying a bond coat and topcoat to a part. Other desirable features and characteristics of the present disclosure will become apparent from the subsequent detailed description and the appended claims, taken in conjunction with the accompanying drawings and this background discussion.

BRIEF SUMMARY

This summary is provided to describe select concepts in a simplified form that are further described in the Detailed Description. This summary is not intended to identify key or essential features of the claimed subject matter, nor is it intended to be used as an aid in determining the scope of the claimed subject matter.

A method of providing a bond coat for a thermal barrier coating of a part of a turbomachine is disclosed. The method includes forming a first metallic bond coat layer on a substrate. The method also includes forming a second bond coat layer on the first metallic bond coat layer. The second bond coat layer has a porosity and a surface roughness that is greater than that of the first metallic bond coat layer. Moreover, the method includes grit blasting the second bond coat layer to densify the second bond coat layer while substantially maintaining the surface roughness thereof.

Also, a part of a turbomachine is disclosed that includes a substrate and a first metallic bond coat layer on the substrate. The part also includes a second bond coat layer on the first metallic bond coat layer. The second bond coat layer has a porosity and a surface roughness that is greater than that of the first metallic bond coat layer. The second bond coat layer is a densified layer with a plurality of collapsed pores. Furthermore, the part includes a thermal barrier layer on top of the second bond coat layer.

Moreover, a manufacturing system for manufacturing a part of a turbomachine is disclosed. The manufacturing system includes a High-Velocity Oxygen Fuel (HVOF) stage configured for forming a first metallic bond coat layer on a substrate of the part via HVOF deposition. The manufacturing system also includes an air plasma spray stage configured for forming a second bond coat layer on the first metallic bond coat layer via air plasma spraying. The second bond coat layer has a porosity and a surface roughness that is greater than that of the first metallic bond coat layer. Additionally, the manufacturing system includes a grit blasting stage configured for grit blasting the second bond coat layer to densify the second bond coat layer while substantially maintaining the surface roughness thereof.

Other desirable features and characteristics of the apparatus and method will become apparent from the subsequent detailed description and the appended claims, taken in conjunction with the accompanying drawings and the preceding background.

BRIEF DESCRIPTION OF THE DRAWINGS

The present disclosure will hereinafter be described in conjunction with the following drawing figures, wherein like numerals denote like elements, and wherein.

DETAILED DESCRIPTION

Figure 1:
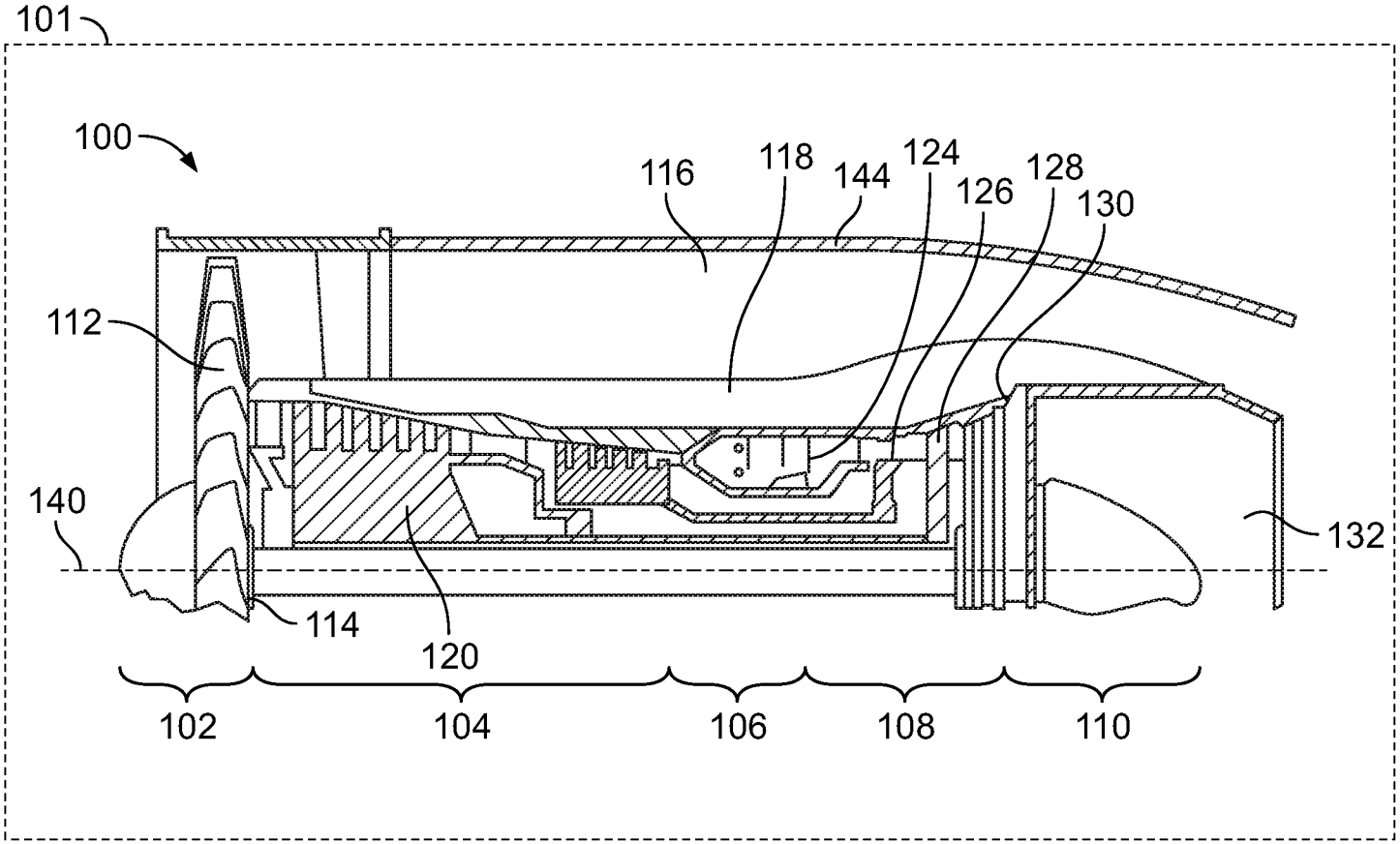
FIG. 1 is a schematic view of a gas turbine engine according to example embodiments of the present disclosure.

The following detailed description is merely exemplary in nature and is not intended to limit the present disclosure or the application and uses of the present disclosure. As used herein, the word "exemplary" means "serving as an example, instance, or illustration." Thus, any embodiment described herein as "exemplary" is not necessarily to be construed as preferred or advantageous over other embodiments. All of the embodiments described herein are exemplary embodiments provided to enable persons skilled in the art to make or use the present disclosure and not to limit the scope of the present disclosure which is defined by the claims. Furthermore, there is no intention to be bound by any expressed or implied theory presented in the preceding technical field, background, brief summary, or the following detailed description.

Broadly, embodiments of the present disclosure include a coated part with an improved bond coat that bonds a ceramic topcoat to a substrate. The present disclosure also includes manufacturing methods and manufacturing systems for providing the improved bond coat.

The bond coat may include a plurality of layers, such as a first layer and a second layer. The first layer may be provided on an underlying surface, such as that of a superalloy substrate. The second layer may be provided on the first layer. The second layer may exhibit higher porosity and surface roughness than the first layer, for example, due to their methods of application. For example, in some embodiments, the first layer may be provided via a thermal spray deposition process (e.g., High Velocity Oxy-Fuel (HVOF) deposition), and the second layer may be provided initially via a plasma spray process (e.g., air plasma spray deposition).

The second layer may provide a predetermined surface roughness. This surface roughness may be within a range that benefits the bonding of the topcoat (e.g., a thermal barrier coating (TBC) layer) to the underlying surface. For example, the TBC layer may be deposited on the second layer via an air plasma spray process. The relatively high surface roughness of the second layer may increase adherence of the thermal barrier coating thereto.

The bond coat, the substrate, and the TBC layer may include a variety of materials. For example, the first and/or second layers of the bond coat may be metallic layers that are rich in aluminum. The other principal constituents of the first and/or second layers of the bond coat may be Nickel, Cobalt, Chromium, and Yttrium (i.e., NiCoCrAlY) bond coatings. The substrate may be a superalloy, and the thermal barrier topcoat may a ceramic layer. Overall, the bond coat may act as a source of aluminum to form a protective, slowly-growing alumina scale at high temperatures that bonds the thermal barrier topcoat to the bond coat. Without such oxide scale, rapidly growing Ni- or Co-based oxides may form at the bond coat surface leading to early spallation of the ceramic thermal barrier coating.

When initially applied, the second layer may include a plurality of pores (i.e., fissures, inter-splat gaps, etc.) due to the air plasma spray deposition method used to form the second layer. If these pores were to remain, they could allow ingress of oxygen into the interior of the bond coat during service at high temperatures. Aluminum may be consumed by oxidation at a relatively high rate both at the bond coat/top coat interface and in the interior of the bond coat. Thus, the oxidation life of such a bond coat would be greatly reduced, resulting in early spallation of the TBC.

However, in embodiments of the present disclosure, the second layer may be a densified layer. More specifically, at least some of the pores may be at least partly closed, compacted, or at least partly collapsed in on themselves. Because of this densification, the second layer may be less prone to ingress of oxygen into the interior of the bond coat. Accordingly, the second layer (and, thus, the overall part) may be more robust.

The second layer may be densified, in some embodiments, using a grit blasting method before application of the thermal barrier coating. Manufacturing parameters (e.g., grit blasting material, pressure, the number of passes, etc.) may be selected such that the second layer is sufficiently densified without substantially changing the surface roughness of the second layer to maintain adhesion with the top coat.

Accordingly, the coated part may exhibit increased oxidation life and robustness. The first layer may have high density and, thus, may not be susceptible to oxidation in the interior and may readily supply aluminum for oxidation protection. Also, the second layer may provide increased adhesion and spallation life of the ceramic TBC due to its relatively high surface roughness.

With reference to FIG. 1, a partial, cross-sectional view of an exemplary gas turbine engine 100 is shown with the remaining portion of the gas turbine engine 100 being substantially axisymmetric about a longitudinal axis 140, which also defines an axis of rotation for the gas turbine engine 100. In the depicted embodiment, the gas turbine engine 100 is an annular multi-spool turbofan gas turbine jet engine within an aircraft (represented schematically at 101), although features of the present disclosure may be included in other configurations, arrangements, and/or uses. For example, in other embodiments, the gas turbine engine 100 may assume the form of a non-propulsive engine, such as an Auxiliary Power Unit (APU) deployed onboard the aircraft 101, an industrial power generator, or other turbomachine.

In this example, with continued reference to FIG. 1, the gas turbine engine 100 includes a fan section 102, a compressor section 104, a combustor section 106, a turbine section 108, and an exhaust section 110. In one example, the fan section 102 includes a fan 112 mounted on a rotor 114 that draws air into the gas turbine engine 100 and compresses it. A fraction of the compressed air exhausted from the fan 112 is directed through the outer bypass duct 116 and the remaining fraction of air exhausted from the fan 112 is directed into the compressor section 104. The outer bypass duct 116 is generally defined by an outer casing 144 that is spaced apart from and surrounds an inner bypass duct 118.

In the embodiment of FIG. 1, the compressor section 104 includes one or more compressors 120. The number of compressors 120 in the compressor section 104 and the configuration thereof may vary. The one or more compressors 120 sequentially raise the pressure of the air and direct a majority of the high-pressure fluid or air into the combustor section 106. In the combustor section 106, which includes a combustion chamber 124, the high-pressure air is mixed with fuel and is combusted. The high-temperature combustion air or combustive gas flow is directed into the turbine section 108. In this example, the turbine section 108 includes three turbines disposed in axial flow series, namely, a high-pressure turbine 126, an intermediate pressure turbine 128, and a low-pressure turbine 130. However, it will be appreciated that the number of turbines, and/or the configurations thereof, may vary. In this embodiment, the high-temperature combusted air from the combustor section 106 expands through and rotates each turbine 126, 128, and 130. The combustive gas flow then exits the turbine section 108 for mixture with the cooler bypass airflow from the outer bypass duct 116 and is ultimately discharged from the gas turbine engine 100 through the exhaust section 132. As the turbines 126, 128, 130 rotate, each drives equipment in the gas turbine engine 100 via concentrically disposed shafts or spools.

Figure 2:
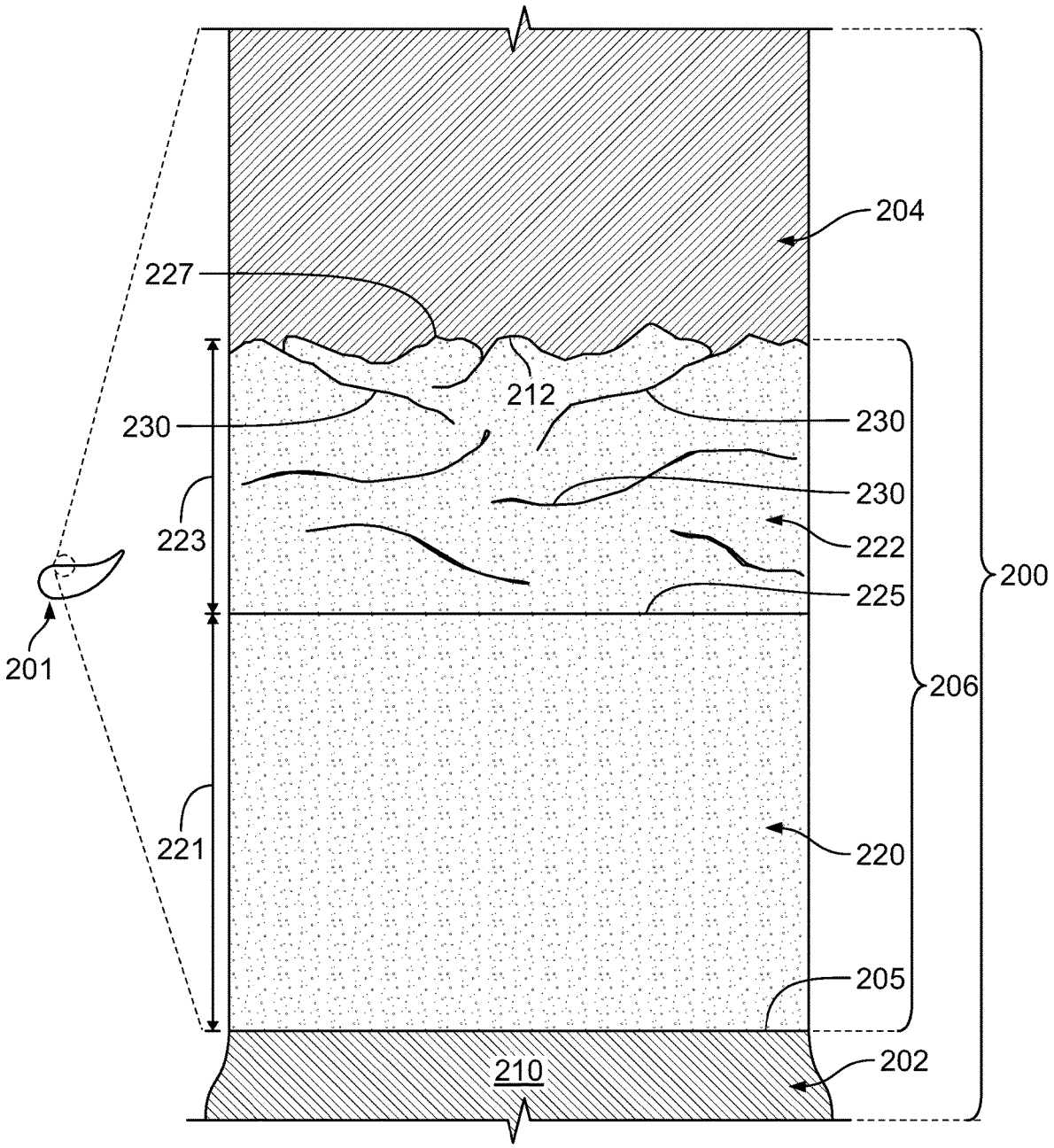
FIG. 2 is a schematic cross section of a coated outer surface of a part of the gas turbine engine according to example embodiments of the present disclosure.

The engine 100 may include at least one part 201 with a coated outer surface 200, such as the airfoil-shaped part 201 shown in FIG. 2. The part 201 may be included in an area of the engine 100 subjected to high-temperature environments. Thus, the part 201 may be included in the combustor section 106, the turbine section 108, etc. In various embodiments, a blade, vane, shroud, combustor liner, or other part of the engine 100 may include the coated outer surface 200. It will be appreciated that the coated outer surface 200 may be included on a component of something other than a gas turbine engine 100 without departing from the scope of the present disclosure.

The coated outer surface 200 may generally include a thermal barrier coating (TBC) layer 204 and a bond coat 206 that bonds the TBC layer 204 to a substrate 202 (i.e., an underlying layer or body). The bond coat 206 may include a variety of features that will be discussed below. The bond coat 206, in some embodiments, may include a plurality of layers with different properties, treatments, etc. as will be discussed. As such, the bond coat 206 may be considered a hybridized bond coat that combines a number of advantageous features.

The substrate 202 may be defined by a part body 210. The part body 210 may define a majority of the part 201. The part body 210 may have a variety of shapes without departing from the scope of the present disclosure. For example, as represented in FIG. 2, the part body 210 may be airfoil-shaped. The part body 210 and, thus, the substrate 202 may be constructed of a superalloy material (e.g., a nickel-based superalloy material). The substrate 202 may include a substrate outer surface 205.

The TBC layer 204 may be a ceramic layer, and the TBC layer 204 may have low thermal conductivity for thermally protecting the underlying body 210. The TBC layer 204 may be made from a variety of materials without departing from the scope of the present disclosure. In some embodiments, the TBC layer 204 may include a rare-earth-doped zirconia. In other words, the zirconia may be doped by an oxide of at least one rare-earth element (e.g., Y, Yb, Sc, Gd, Er, La, etc.). Also, the TBC layer 204 may be a yttria-stabilized zirconia (YSZ) or other rare-earth-stabilized zirconia. The TBC layer 204 may include an inner surface 212 that faces the substrate 202 and that is bonded to the bond coat 206. As such, the TBC layer 204 may define the outermost portion of the coated outer surface 200.

The bond coat 206, in some embodiments, may include a plurality of layers. In some embodiments, the bond coat 206 may include a first layer 220 and a second layer 222. The second layer 222 may be referred to as a "flash layer" of the bond coat 206.

The first layer 220 may be a metallic bond coat. The first layer 220 may include aluminum, and the first layer 220 may also include nickel, cobalt, chromium, and yttrium (i.e., a NiCoCrAlY bond coating layer). The first layer 220 may be layered on the substrate outer surface 205 and may be provided at a predetermined thickness 221. The thickness 221 may be measured between the substrate outer surface 205 and a first layer outer surface 225 of the first layer 220. The first layer 220 may have relatively low porosity. For example, the porosity of the first layer 220 may exhibit, at most, approximately five percent (5%) porosity. Additionally, the first layer outer surface 225 may have relatively low surface roughness (e.g., a low Ra value). These characteristics may be a result of the method in which the first layer 220 is deposited on the substrate 202. For example, as will be discussed, the first layer 220 may be deposited using a High Velocity Oxy-Fuel (HVOF) deposition method designed to produce high-density coatings. Thus, the first layer 220 may be referred to as a "HVOF deposited first bond coat layer," having low porosity.

The second layer 222 may be a metallic bond coat. The second layer 222 may include aluminum, and the second layer 222 may also include nickel, cobalt, chromium, and yttrium (i.e., a NiCoCrAlY bond coating layer). The second layer 222 may be deposited on the first layer 220 and may be provided at a predetermined thickness 223. The thickness 223 may be measured between the first layer outer surface 225 and a second layer outer surface 227 facing away therefrom. The second layer 222 may have higher porosity than the first layer 220. Furthermore, the second layer outer surface 227 may have higher surface roughness (e.g., a higher Ra value) than that of the first layer outer surface 225. These characteristics may be a result of the method in which the second layer 222 is deposited on the first layer 220. For example, as will be discussed, the second layer 222 may be deposited using an air plasma spray deposition method. Thus, the second layer 222 may be referred to as an "air plasma sprayed second bond coat layer," which particularly provides high surface roughness for bonding the TBC layer 204 to the second layer outer surface 227.

The total thickness of the bond coat 206 (i.e., the sum of the first and second thicknesses 221, 223) may be determined based on the various factors, such as the thickness of the TBC layer 204. The thickness 223 of the second layer 222 may be less than the thickness 221 of the first layer 220.

The second layer 222 may include a plurality of pores 230. Those having ordinary skill in the art will recognize that the pores 230 are illustrated schematically for simplicity. The pores 230 may extend in various directions and may exist in various locations throughout the thickness of the second layer 222.

While the porosity of the second layer 222 may be higher than that of the first layer 220, the second layer 222 may be a densified layer such that the pores 230 are collapsed, closed, or otherwise reduced in size. The second layer 222 may be densified via a grit blasting process as will be discussed. The densified second layer 222 may, thus, provide increased protection against oxidation and may make the coated outer surface 200 more robust.

Figure 3:
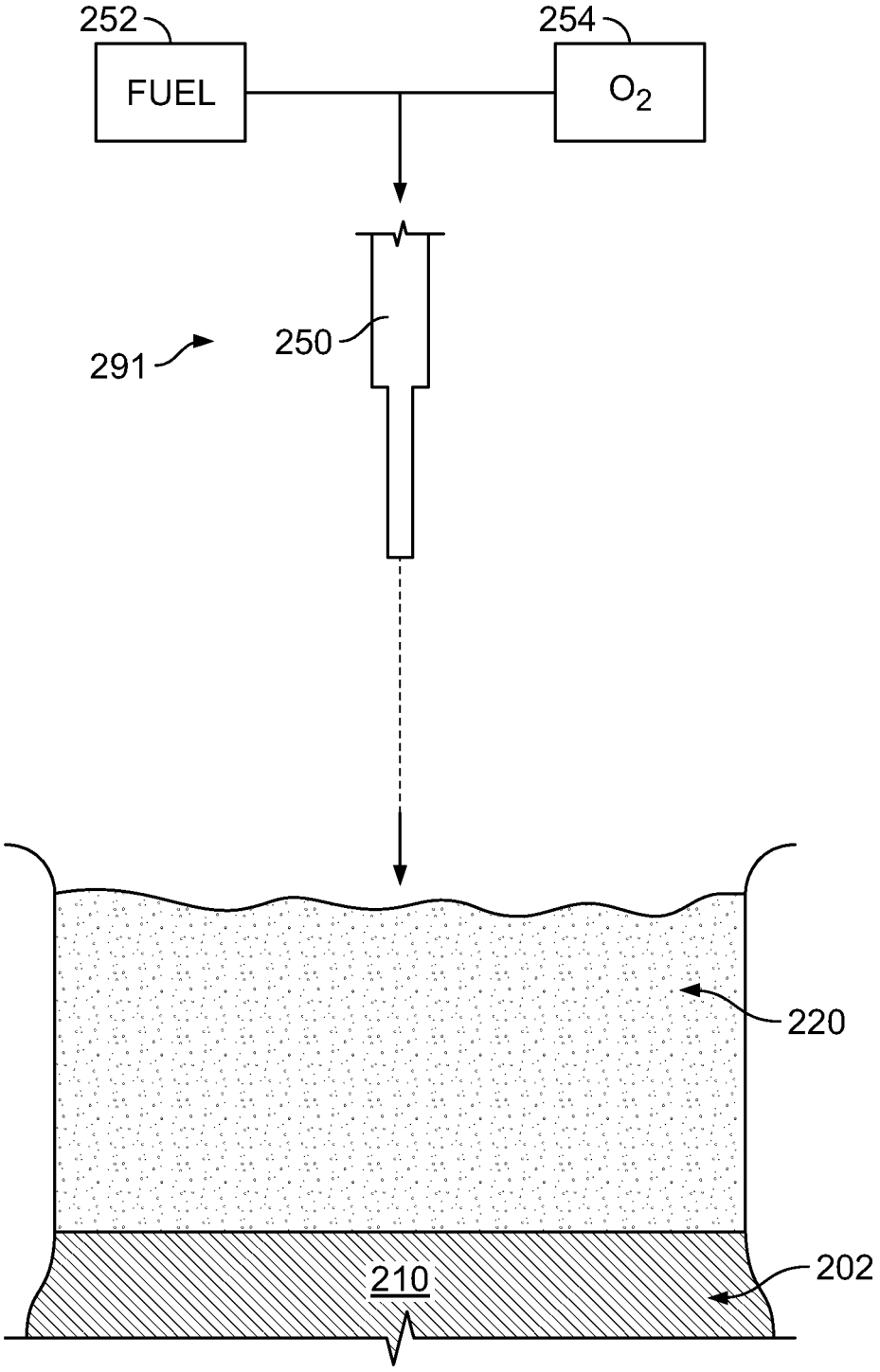
FIGS. 3-5 are schematic illustrations of a manufacturing system shown employing a method of manufacturing the coated outer surface of FIG. 2 according to example embodiments of the present disclosure.
Figure 4:
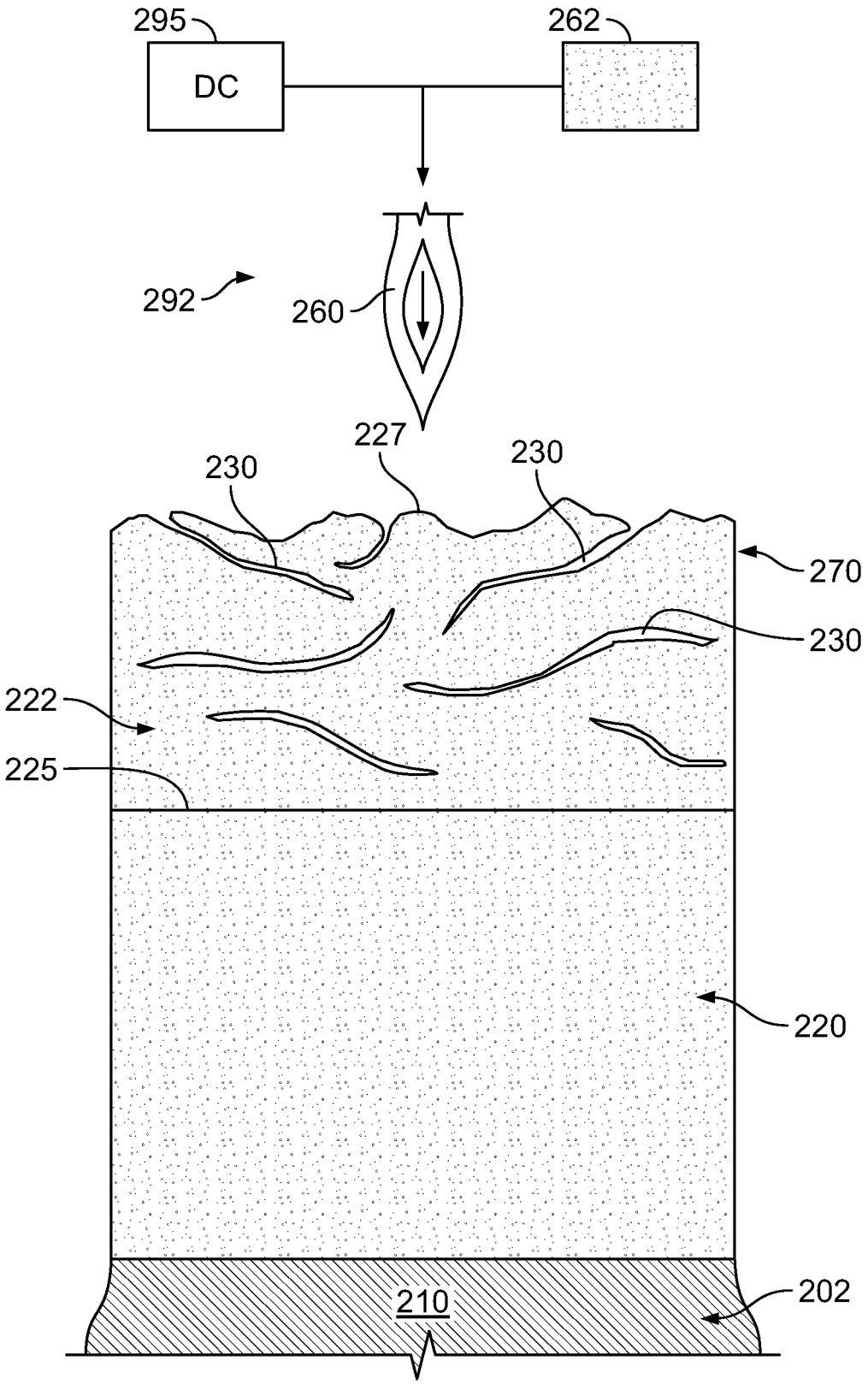
Figure 5:
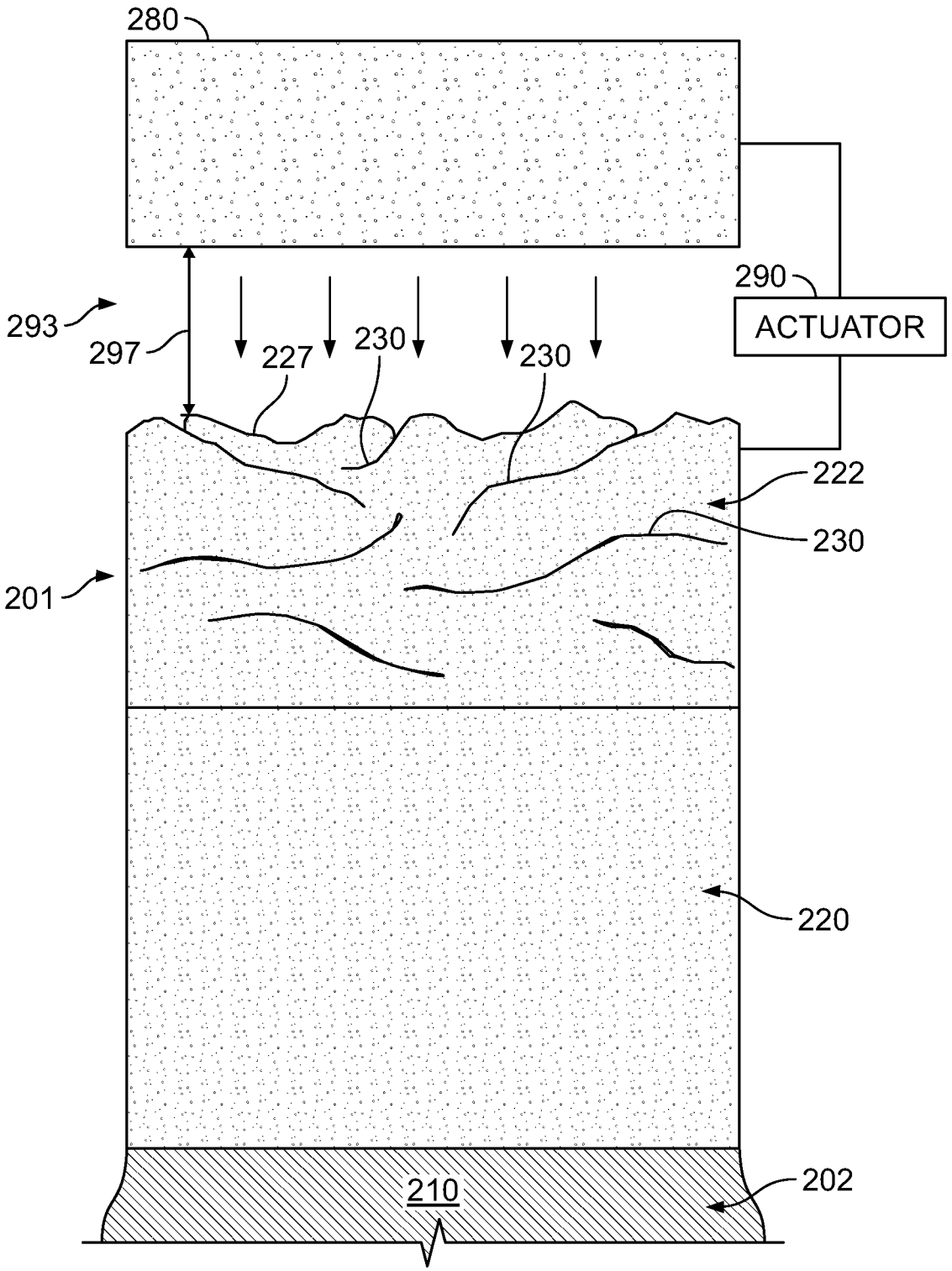

Referring now to FIGS. 3-5, methods of forming the coated outer surface 200 will be discussed according to example embodiments. As will be discussed, these methods and the associated manufacturing systems are efficient and cost effective. They can be employed repeatably for making parts at high volume.

As shown in FIG. 3, manufacture of the coated outer surface 200 may begin in a first thermal spray stage 291. In some embodiments, the first thermal spray stage 291 of the manufacturing system may be configured for HVOF spraying of the first layer 220. However, it will be appreciated that other manufacturing techniques (e.g., different thermal spraying techniques) may be utilized. In embodiments in which the first thermal spray stage 291 is configured for HVOF (i.e., a HVOF stage), a spraying tool 250 may be used and directed toward the substrate 202. Heat and pressure are generated from the combustion of a liquid or gas fuel 252 mixed with oxygen 254. The mixture is combusted in a chamber where it heats and expands, forcing the exhaust gases out of the spraying tool 250 at supersonic speeds. Metallic particles for forming the first layer 220 may also be provided to the spraying tool 250 to deposit and grow the first layer 220 on the substrate 202. As a result of this application method, the first layer 220 may exhibit high strength bonding to the substrate 202 as well as relatively low porosity and low surface roughness.

Once the first layer 220 is provided, the second layer 222 may be layered thereon in a second thermal spray stage 292 as represented in FIG. 4. The second layer 222 may be deposited using a plasma spray method. In other words, the second thermal spray stage 292 may be configured for plasma spraying. More specifically, a DC electric arc 295 may be used to form a high temperature plasma jet 260. A powdered metallic material 262 may be provided and consumed as it is fed into and around the plasma jet 260. The material may be directed toward the first layer outer surface 225 to deposit the second layer 222 thereon. Furthermore, the second layer 222 may be applied in a vacuum or argon atmosphere in some embodiments to provide desired characteristics.

As represented in FIG. 4, an initial structure 270 of the second layer 222 may be provided using the plasma spray method. The initial structure 270 may provide the second layer outer surface 227 with the desired surface roughness. The initial structure 270 may have relatively high porosity, and the pores 230 may be open with a larger volume.

However, as shown in FIG. 5, the second layer outer surface 227 may be grit blasted at a grit blasting stage 293 of the manufacturing system. More specifically, a grit blasting tool 280 may bombard the second layer outer surface 227 with a predetermined grit material to densify the second layer 222. The force of the grit blasting can cause the pores 230 to collapse in on themselves and reduce in volume by plastic deformation, as shown. At least some of the pores 230 may be surface-connected pores (i.e., extending from the outer surface 227 and into the thickness of the second layer 222). Closing these surface-connected pores 230 can significantly limit ingress of oxygen into the thickness of the bond coat 206 for increased oxidation protection.

In some embodiments, the grit blasting tool 280 and/or the part 201 may be mounted to an actuator system 290. The actuator system 290 may automatically move the grit blasting tool 280 and/or the part 201 relative to the other in a controlled manner. Accordingly, densification of the second layer 222 may be highly controllable.

Various parameters of the manufacturing process of FIGS. 3-5 may be chosen specifically to provide the second layer 222 with desired characteristics. Some parameters may be selected to provide the second layer 222 with surface roughness that falls within a predetermined range. Grit blasting parameters may be chosen to ensure that the surface roughness of the second layer outer surface 227 is largely unaffected by the grit blasting process. For example, the Ra value of the second layer outer surface 227 may be between 150 and 325 micro-inches before grit blasting. After grit blasting, and once the second layer 222 has been densified, the Ra value of the second layer outer surface 227 may be between 150 and 325 micro-inches. Also, these parameters may be chosen according to the thickness of the TBC layer 204 and/or the expected service conditions of the part 201.

In some embodiments, the grit size of the grit material used by the grit blasting tool 280 may be selected and predetermined to produce the desired outcome. In some embodiments, the grit size may be between approximately 36 and 220 mesh.

Furthermore, the grit material may be selected for providing the second layer 222 with the desired characteristics. In some embodiments, the grit material utilized by the grit blasting tool 280 may include aluminum oxide (alumina). Additionally, the grit blasting stage 293 may be selectively controlled such that the grit blasting tool 280 blasts the grit at a predetermined pressure.

Moreover, the actuator system 290 may be selectively controlled such that the tool 280 moves relative to the part 201 in a controlled manner. The actuator system 290 may be operated to control the number of horizontal passes of the tool 280 relative to the part 201. The actuator system 290 may also be controlled to selectively move the tool 280 and/or the part 201 to a predetermined vertical distance 297 apart. Controlling the number of passes and/or the distance 297 during the grit blasting process can, thereby, control the densification process without significantly changing the surface roughness of the second layer outer surface 227.

Once the second layer 222 is formed, the TBC layer 204 may be formed thereon (FIG. 2). In some embodiments, the TBC layer 204 may be formed via an air plasma spray technique. The surface roughness of the second layer outer surface 227 may be advantageous for deposition and robust adherence of the TBC layer 204.

Thus, in summary, the bond coat 206 of the present disclosure is highly robust. The manufacturing methods and systems used to produce this bond coat 206 are also highly efficient.

In this document, relational terms such as first and second, and the like may be used solely to distinguish one entity or action from another entity or action without necessarily requiring or implying any actual such relationship or order between such entities or actions. Numerical ordinals such as "first," "second," "third," etc. simply denote different singles of a plurality and do not imply any order or sequence unless specifically defined by the claim language. The sequence of the text in any of the claims does not imply that process steps must be performed in a temporal or logical order according to such sequence unless it is specifically defined by the language of the claim. The process steps may be interchanged in any order without departing from the scope of the invention as long as such an interchange does not contradict the claim language and is not logically nonsensical.

Furthermore, depending on the context, words such as "connect" or "coupled to" used in describing a relationship between different elements do not imply that a direct physical connection must be made between these elements. For example, two elements may be connected to each other physically, electronically, logically, or in any other manner, through one or more additional elements.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention. It being understood that various changes may be made in the function and arrangement of elements described in an exemplary embodiment without departing from the scope of the invention as set forth in the appended claims.

What is claimed is:

1. A method of providing a bond coat for a thermal barrier coating of a part of a turbomachine, the method comprising:

forming a first metallic bond coat layer on a substrate;

forming a second bond coat layer on the first metallic bond coat layer, the second bond coat layer having a porosity and a surface roughness that is greater than that of the first metallic bond coat layer; and grit blasting the second bond coat layer to densify the second bond coat layer while substantially maintaining the surface roughness thereof.

2. The method of claim 1, wherein forming the first metallic bond coat layer includes forming the first metallic bond coat layer by a High Velocity Oxy-Fuel (HVOF) deposition method.

3. The method of claim 1, wherein forming the second bond coat layer includes forming the second bond coat layer by air plasma spray.

4. The method of claim 1, wherein forming the first metallic bond coat layer includes forming the first metallic bond coat layer to have, at most, approximately five percent (5%) porosity.

5. The method of claim 1, wherein forming the second bond coat layer includes:

forming an initial structure of the second bond coat layer on the first metallic bond coat layer, the initial structure having an outer surface facing away from the first metallic bond coat layer, the initial structure having a plurality of surface-connected pores that extend from the outer surface into the initial structure in a thickness direction; and wherein grit blasting includes densifying the initial structure to collapse at least some of the plurality of surface-connected pores.

6. The method of claim 5, wherein forming the initial structure includes forming the initial structure with an Ra value of the outer surface being between approximately 150 and 325 micro-inches; and wherein grit blasting includes densifying the initial structure while maintaining the Ra value of the outer surface between approximately 150 and 325 micro-inches.

7. The method of claim 1, further comprising selecting a plurality of grit blasting parameters for grit blasting the second bond coat layer, the plurality of grit blasting parameters chosen from a group consisting of a grit size, a blast pressure, a distance between a grit blasting nozzle and an outer surface of the second bond coat layer, and a number of passes of the grit blasting nozzle across the outer surface.

8. The method of claim 1, wherein grit blasting includes grit blasting with a grit material that includes aluminum oxide.

9. The method of claim 1, wherein grit blasting includes grit blasting with a grit material having a grit size between approximately 36 and 220 mesh.

10. The method of claim 1, wherein the second bond coat layer has a thickness that is less than that of the first metallic bond coat layer.

11. The method of claim 1, further comprising plasma spraying the thermal barrier coating to the grit blasted second bond coat layer.

* * * * *